US011270630B2

(12) United States Patent
Xuan et al.

(10) Patent No.: US 11,270,630 B2
(45) Date of Patent: Mar. 8, 2022

(54) DRIVING CIRCUIT, DRIVING METHOD THEREOF AND DISPLAY APPARATUS

(71) Applicant: BOE TECHNOLOGY GROUP CO., LTD., Beijing (CN)

(72) Inventors: Minghua Xuan, Beijing (CN); Xiaochuan Chen, Beijing (CN); Han Yue, Beijing (CN); Ning Cong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 228 days.

(21) Appl. No.: 16/620,683

(22) PCT Filed: Jun. 28, 2019

(86) PCT No.: PCT/CN2019/093785

§ 371 (c)(1),
(2) Date: Dec. 9, 2019

(87) PCT Pub. No.: WO2020/001635

PCT Pub. Date: Jan. 2, 2020

(65) Prior Publication Data

US 2021/0366364 A1 Nov. 25, 2021

(30) Foreign Application Priority Data

Jun. 29, 2018 (CN) ..... 201810696655.5

(51) Int. Cl.
*G09G 3/32* (2016.01)
*G09G 3/20* (2006.01)

(52) U.S. Cl.
CPC ..... *G09G 3/32* (2013.01); *G09G 3/2074* (2013.01); *G09G 2300/0426* (2013.01);
(Continued)

(58) Field of Classification Search
CPC ..... G09G 3/32; G09G 3/2074; G09G 2300/0426; G09G 2300/0819;
(Continued)

(56) References Cited

U.S. PATENT DOCUMENTS

2006/0022907 A1 2/2006 Uchino et al.
2006/0164345 A1 7/2006 Sarma et al.
(Continued)

FOREIGN PATENT DOCUMENTS

CN 1722207 A 1/2006
CN 102314829 A 1/2012
(Continued)

OTHER PUBLICATIONS

Indian Office Action dated May 31, 2021 corresponding to application No. 202047027129.
(Continued)

*Primary Examiner* — Andrew Sasinowski
(74) *Attorney, Agent, or Firm* — Nath, Goldberg & Meyer; Joshua B. Goldberg

(57) ABSTRACT

The embodiments of the present disclosure provide a driving circuit, a driving method thereof and a display apparatus, and relates to the field of display technology. The driving circuit is configured to drive a to-be-driven element and includes a driving element. The driving element and the to-be-driven element are coupled in series between a first operating voltage terminal and a second operating voltage terminal. The driving element comprises a driving sub-circuit, a writing sub-circuit and a gray scale control sub-circuit. The writing sub-circuit writes a first data voltage provided by the first data signal terminal into the driving sub-circuit. The gray scale control sub-circuit transmits the first operating voltage provided by the first operating voltage terminal to the driving sub-circuit. The driving sub-circuit
(Continued)

generates a drive current. The gray scale control sub-circuit also controls an on-state duration of the current path.

20 Claims, 13 Drawing Sheets

(52) U.S. Cl.
CPC ..... *G09G 2300/0819* (2013.01); *G09G 2310/0248* (2013.01); *G09G 2320/0233* (2013.01); *G09G 2320/0252* (2013.01)

(58) Field of Classification Search
CPC ... G09G 2310/0248; G09G 2320/0233; G09G 2320/0252
See application file for complete search history.

(56) References Cited

U.S. PATENT DOCUMENTS

| | | | | |
|---|---|---|---|---|
| 2009/0002586 | A1* | 1/2009 | Kimura | G02F 1/13624 349/39 |
| 2009/0115771 | A1 | 5/2009 | Washio | |
| 2012/0001893 | A1 | 1/2012 | Jeong et al. | |
| 2014/0104326 | A1 | 4/2014 | Roh | |
| 2014/0175447 | A1* | 6/2014 | Yamashita | H01L 27/3265 257/71 |
| 2014/0291640 | A1* | 10/2014 | Miyake | H01L 27/3262 257/40 |
| 2015/0348473 | A1* | 12/2015 | Van Lier | G09G 3/3466 345/208 |
| 2016/0240134 | A1 | 8/2016 | Yang et al. | |
| 2018/0211592 | A1* | 7/2018 | Li | G09G 3/3233 |
| 2019/0096317 | A1 | 3/2019 | Chen et al. | |
| 2019/0304367 | A1 | 10/2019 | Li et al. | |
| 2020/0243013 | A1* | 7/2020 | Wang | G09G 3/3233 |

FOREIGN PATENT DOCUMENTS

| | | | |
|---|---|---|---|
| CN | 104599638 | A | 5/2015 |
| CN | 107038997 | A | 8/2017 |
| CN | 107068066 | A | 8/2017 |
| CN | 107452331 | A | 12/2017 |
| CN | 107481664 | A | 12/2017 |
| CN | 108538241 | A | 9/2018 |
| KR | 20090011638 | U | 2/2009 |
| KR | 10-2014-0133189 | A | 11/2014 |
| KR | 20140133189 | A | 11/2014 |
| KR | 10-2018-0058268 | A | 6/2018 |
| KR | 20180058268 | A | 6/2018 |
| WO | 2007/058014 | A1 | 5/2007 |

OTHER PUBLICATIONS

Office Action dated Aug. 5, 2019 issued in corresponding Chinese Application No. 201810696655.5.
Office Action dated May 11, 2020 issued in corresponding Chinese Application No. 201810696655.5.
Notification of Reason for Refusal dated Mar. 15, 2021 issued in corresponding Korean Application No. 10-2020-7013570.
Amendment dismissal dated Sep. 28, 2021 for application No. KR 10-2020-7013570 with English translation attached.
Second Rejection dated Sep. 28, 2021 for application No. KR 10-2020-7013570 with English translation attached.

* cited by examiner

DRIVING CIRCUIT, DRIVING METHOD THEREOF AND DISPLAY APPARATUS

CROSS-REFERENCE TO RELATED APPLICATION

This is a National Phase Application filed under 35 U.S.C. 371 as a national stage of PCT/CN2019/093785, filed on Jun. 28, 2019, an application claiming the benefit of priority to Chinese Patent Application No. 201810696655.5 filed on Jun. 29, 2018, the contents of which are incorporated herein in their entirety by reference.

TECHNICAL FIELD

The present disclosure belongs to the field of display technology, and particularly relates to a driving circuit, a driving method thereof, and a display apparatus.

BACKGROUND

Compared with an Organic Light Emitting Diode (OLED) display apparatus, a tiny LED display apparatus (e.g., a Micro LED display apparatus or a μLED display apparatus) has advantages of low driving voltage, long life, resistance to wide temperature ranges, and the like, and is gradually applied to the field of mobile terminals.

SUMMARY

In one aspect, the present disclosure provides a driving circuit, including a driving element for driving a to-be-driven element;

the driving element and the to-be-driven element are coupled in series between a first operating voltage terminal and a second operating voltage terminal; the driving element is configured to provide a driving signal to the to-be-driven element and control an on-state duration of a current path between the first operating voltage terminal and the second operating voltage terminal;

the driving element includes a driving sub-circuit, a writing sub-circuit and a gray scale control sub-circuit;

the writing sub-circuit is coupled to a first scanning signal terminal, a first data signal terminal and the driving sub-circuit; the writing sub-circuit is configured to write a first data voltage provided by the first data signal terminal into the driving sub-circuit under control of the first scanning signal terminal;

the gray scale control sub-circuit is coupled to a driving control signal terminal, a second scanning signal terminal, a second data signal terminal and the driving sub-circuit;

the gray scale control sub-circuit is configured to transmit a first operating voltage provided by the first operating voltage terminal to the driving sub-circuit under control of the driving control signal terminal;

the driving sub-circuit is configured to generate the driving signal according to the first data voltage and the first operating voltage; and the gray scale control sub-circuit is further configured to control the on-state duration of the current path under control of the driving control signal terminal, the second scanning signal terminal, and the second data signal terminal.

According to an embodiment of the present disclosure, the gray scale control sub-circuit includes a first control sub-circuit and a second control sub-circuit;

the first control sub-circuit is coupled to the driving control signal terminal, the driving sub-circuit and the second control sub-circuit; the first control sub-circuit is configured to transmit the first operating voltage provided by the first operating voltage terminal to the driving sub-circuit under control of the driving control signal terminal;

the first control sub-circuit is further configured to, under control of the driving control signal terminal, transmit a driving current generated by the driving sub-circuit to the second control sub-circuit, and control the on-state duration of the current path;

the second control sub-circuit is further coupled to the second scanning signal terminal and the second data signal terminal; the second control sub-circuit is configured to control the on-state duration of the current path under control of the second scanning signal terminal and the second data signal terminal.

According to an embodiment of the present disclosure, the driving circuit further includes a compensation sub-circuit;

the compensation sub-circuit is coupled to the first scanning signal terminal and the driving sub-circuit; the compensation sub-circuit is configured to compensate a threshold voltage of the driving sub-circuit under control of the first scanning signal terminal.

According to an embodiment of the present disclosure, the driving circuit further includes a reset sub-circuit;

the reset sub-circuit is coupled to a reset voltage terminal, a reset control signal terminal and the driving sub-circuit; the reset sub-circuit is configured to transmit a reset voltage provided by the reset voltage terminal to the driving sub-circuit under control of the reset control signal terminal.

According to an embodiment of the present disclosure, the first control sub-circuit includes a first transistor and a second transistor;

an anode of the to-be-driven element is coupled to the second control sub-circuit, a cathode of the to-be-driven element is coupled to the second operating voltage terminal; a gate electrode of the first transistor is coupled to the driving control signal terminal, a first electrode of the first transistor is coupled to the first operating voltage terminal, and a second electrode of the first transistor is coupled to the driving sub-circuit;

a gate electrode of the second transistor is coupled to the driving control signal terminal, a first electrode of the second transistor is coupled to the driving sub-circuit, and a second electrode of the second transistor is coupled to the second control sub-circuit.

According to an embodiment of the present disclosure, the first control sub-circuit includes a first transistor and a second transistor;

an anode of the to-be-driven element is coupled to the first operating voltage terminal; a gate electrode of the first transistor is coupled to the driving control signal terminal, a first electrode of the first transistor is coupled to a cathode of the to-be-driven element, and a second electrode of the first transistor is coupled to the driving sub-circuit;

a gate electrode of the second transistor is coupled to the driving control signal terminal, a first electrode of the second transistor is coupled to the driving sub-circuit, and a second electrode of the second transistor is coupled to the second control sub-circuit.

According to an embodiment of the present disclosure, the second control sub-circuit is further coupled to a first voltage terminal; the second control sub-circuit includes a third transistor, a fourth transistor and a first capacitor;

a gate electrode of the third transistor is coupled to the second scanning signal terminal, a first electrode of the third transistor is coupled to the second data signal terminal, and a second electrode of the third transistor is coupled to a gate electrode of the fourth transistor;

one terminal of the first capacitor is coupled to the second electrode of the third transistor, and the other terminal of the first capacitor is coupled to the first voltage terminal;

a cathode of the to-be-driven element is coupled to the second operating voltage terminal; a first electrode of the fourth transistor is coupled to the first control sub-circuit, and a second electrode of the fourth transistor is coupled to an anode of the to-be-driven element.

According to an embodiment of the present disclosure, the second control sub-circuit is further coupled to a first voltage terminal; the second control sub-circuit includes a third transistor, a fourth transistor and a first capacitor;

a gate electrode of the third transistor is coupled to the second scanning signal terminal, a first electrode of the third transistor is coupled to the second data signal terminal, and a second electrode of the third transistor is coupled to a gate electrode of the fourth transistor;

one terminal of the first capacitor is coupled to the second electrode of the third transistor, and the other terminal of the first capacitor is coupled to the first voltage terminal;

an anode of the to-be-driven element is coupled to the first operating voltage terminal, a cathode of the to-be-driven element is coupled to the first control sub-circuit; a first electrode of the fourth transistor is coupled to the first control sub-circuit, and a second electrode of the fourth transistor is coupled to the second operating voltage terminal.

According to an embodiment of the present disclosure, the driving sub-circuit is further coupled to a second voltage terminal, and the driving sub-circuit includes a driving transistor;

a gate electrode of the driving transistor is coupled to the second voltage terminal, a first electrode of the driving transistor is coupled to the writing sub-circuit, and a second electrode of the driving transistor is coupled to the gray scale control sub-circuit.

According to an embodiment of the present disclosure, the driving sub-circuit is further coupled to a second voltage terminal, and the driving sub-circuit includes a driving transistor and a second capacitor;

a gate electrode of the driving transistor is coupled to one terminal of the second capacitor, a first electrode of the driving transistor is coupled to the writing sub-circuit, and a second electrode of the driving transistor is coupled to the gray scale control sub-circuit; and the other terminal of the second capacitor is coupled to the second voltage terminal.

According to an embodiment of the present disclosure, the writing sub-circuit includes a fifth transistor;

a gate electrode of the fifth transistor is coupled to the first scanning signal terminal, a first electrode of the fifth transistor is coupled to the first data signal terminal, and a second electrode of the fifth transistor is coupled to the driving sub-circuit.

According to an embodiment of the present disclosure, the compensation sub-circuit includes a sixth transistor;

a gate electrode of the sixth transistor is coupled to the first scanning signal terminal, and first and second electrodes of the sixth transistor are coupled to the driving sub-circuit.

According to an embodiment of the present disclosure, the reset sub-circuit includes a seventh transistor;

a gate electrode of the seventh transistor is coupled to the reset control signal terminal, a first electrode of the seventh transistor is coupled to the reset voltage terminal, and a second electrode of the seventh transistor is coupled to the driving sub-circuit.

According to an embodiment of the present disclosure, the to-be-driven element is a tiny light emitting diode.

In another aspect, the present disclosure provides a driving circuit for driving a to-be-driven element, the driving circuit including first to seventh transistors, a first capacitor, a second capacitor, a driving transistor, a reset control signal terminal, a driving control signal terminal, a first data signal terminal, a second data signal terminal, a first scanning signal terminal, a second scanning signal terminal, a first operating voltage terminal, a first voltage terminal, and a second voltage terminal, the driving control signal terminal is coupled to a gate electrode of the first transistor and a gate electrode of the second transistor, the first data signal terminal is coupled to a first electrode of the fifth transistor, the second data signal terminal is coupled to a first electrode of the third transistor, the first scanning signal terminal is coupled to a gate electrode of the fifth transistor and a gate electrode of the sixth transistor, the second scanning signal terminal is coupled to a gate electrode of the third transistor, the first operating voltage terminal is coupled to a first electrode of the first transistor, the first voltage terminal is coupled to one terminal of the first capacitor, the second voltage terminal is coupled to one terminal of the second capacitor, the reset control signal terminal is coupled to a gate electrode of the seventh transistor, the reset voltage terminal is coupled to a first electrode of the seventh transistor, a second electrode of the first transistor and a second electrode of the fifth transistor are coupled to a first electrode of the driving transistor, the other terminal of the second capacitor, a second electrode of the sixth transistor and a second electrode of the seventh transistor are coupled to a gate electrode of the driving transistor, a first electrode of the second transistor and a first electrode of the sixth transistor are coupled to a second electrode of the driving transistor, a second electrode of the second transistor is coupled to a first electrode of the fourth transistor, the other terminal of the first capacitor and a second electrode of the third transistor are coupled to a gate electrode of the fourth transistor, and a second electrode of the fourth transistor is coupled to the to-be-driven element.

In another aspect, the present disclosure provides a driving circuit for driving a to-be-driven element, the driving circuit including first to seventh transistors, a first capacitor, a second capacitor, a driving transistor, a reset control signal terminal, a driving control signal terminal, a first data signal terminal, a second data signal terminal, a first scanning signal terminal, a second scanning signal terminal, a power voltage terminal, a first voltage terminal, and a second voltage terminal, the driving control signal terminal is coupled to a gate electrode of the first transistor and a gate electrode of the second transistor, the first data signal terminal is coupled to a first electrode of the fifth transistor, the second data signal terminal is coupled to a first electrode of the third transistor, the first scanning signal terminal is coupled to a gate electrode of the fifth transistor and a gate electrode of the sixth transistor, the second scanning signal terminal is coupled to a gate electrode of the third transistor, the power voltage terminal is coupled to a second electrode of the fourth transistor, the first voltage terminal is coupled to one terminal of the first capacitor, the second voltage terminal is coupled to one terminal of the second capacitor, the reset control signal terminal is coupled to a gate electrode of the seventh transistor, the reset voltage terminal is coupled to a first electrode of the seventh transistor, a second electrode of the first transistor and a second electrode of the fifth transistor are coupled to a first electrode of the driving transistor, the other terminal of the second capacitor, a second electrode of the sixth transistor and a second electrode of the seventh transistor are coupled to a gate electrode of the driving transistor, a first electrode of the second transistor and a first electrode of the sixth transistor are coupled to a second electrode of the driving transistor, a second electrode of the second transistor is coupled to a first electrode of the fourth transistor, the other terminal of the first capacitor and a second electrode of the third transistor are coupled to a gate electrode of the fourth transistor, a first electrode of the first transistor is coupled to the to-be-driven element.

In another aspect, the present disclosure provides a display apparatus, including a display substrate, the display substrate having a display region including a plurality of sub-pixels, at least one of the plurality of sub-pixels being provided therein with the driving circuit according to the embodiments of the present disclosure and a to-be-driven element, the driving circuit being configured to provide a driving signal to the to-be-driven element.

In another aspect, the present disclosure provides a driving method for a driving circuit according to an embodiment of the present disclosure, wherein the driving circuit operates in a plurality of scanning periods in an image frame; the gray scale control sub-circuit includes a first control sub-circuit and a second control sub-circuit; in the scanning period, the driving method includes the following steps:

providing a first scanning signal to the first scanning signal terminal, providing a first data voltage to the first data signal terminal, and writing the first data voltage into the driving sub-circuit through the writing sub-circuit;

providing a second scanning signal to the second scanning signal terminal, and providing a second data voltage to the second data signal terminal, so that the second control sub-circuit is turned on or turned off under control of the second scanning signal and the second data voltage; and providing a driving control signal to the driving control signal terminal, providing a first operating voltage to the first operating voltage terminal, the first operating voltage being transmitted to the driving sub-circuit through the first control sub-circuit, so that the to-be-driven element operates based on the first data voltage and the first operating voltage under control of the driving control signal, the first scanning signal, the second scanning signal and the second data voltage.

According to an embodiment of the present disclosure, the method further includes:

in the scanning period, a time of providing an active signal by the second scanning signal terminal is later than a time of providing an active signal by the first scanning signal terminal.

According to an embodiment of the present disclosure, the driving circuit further includes a reset sub-circuit, and prior to providing a first scanning signal to the first scanning signal terminal, providing a first data voltage to the first data signal terminal, and writing the first data voltage into the driving sub-circuit through the writing sub-circuit, the method further includes:

providing a reset control signal to a reset control signal terminal, and providing a reset voltage to a reset voltage terminal, wherein the reset voltage is transmitted to the driving sub-circuit through the reset sub-circuit.

According to an embodiment of the present disclosure, the driving sub-circuit includes a driving transistor and a second capacitor; a gate electrode of the driving transistor is coupled to one terminal of the second capacitor, the other terminal of the second capacitor is coupled to a second voltage terminal, and a voltage provided to the second voltage terminal is the same as a voltage provided to the first operating voltage terminal.

BRIEF DESCRIPTION OF THE DRAWINGS

In order to more clearly illustrate the embodiments of the present disclosure or the technical solutions in the prior art, the drawings used in the description of the embodiments or the prior art will be briefly described below, it is obvious that the drawings described below are only some embodiments of the present disclosure, and other drawings can be obtained therefrom by those skilled in the art without creative efforts.

DETAILED DESCRIPTION

The technical solutions in the embodiments of the present disclosure will be clearly and completely described below with reference to the drawings in the embodiments of the present disclosure, and it is obvious that the described embodiments are only a part of the embodiments of the present disclosure, and not all of the embodiments. All other embodiments, which can be derived by a person skilled in the art from the embodiments disclosed herein without making any creative effort, shall fall within the protection scope of the present disclosure.

Figure 1:
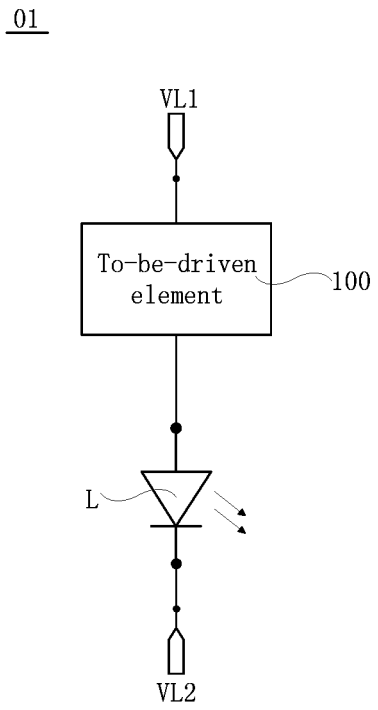
FIG. 1 is a schematic structural diagram of a driving circuit according to some embodiments of the present disclosure.
Figure 2:
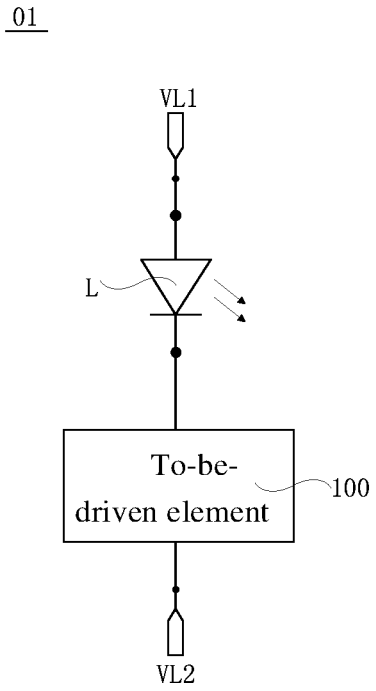
FIG. 2 is a schematic structural diagram of another driving circuit according to some embodiments of the present disclosure.

Some embodiments of the present disclosure provide a driving circuit 01, as shown in FIG. 1 or FIG. 2, including a driving element 100 and a to-be-driven element L.

The driving element 100 and the to-be-driven element L are coupled in series between a first operating voltage terminal VL1 and a second operating voltage terminal VL2.

For example, as shown in FIG. 1, the driving element 100 is coupled between the first operating voltage terminal VL1 and an anode of the to-be-driven element L, and a cathode of the to-be-driven element L is coupled to the second operating voltage terminal VL2.

Alternatively, for another example, as shown in FIG. 2, the driving element 100 is coupled between the second operating voltage terminal VL2 and the cathode of the to-be-driven element L, and the anode of the to-be-driven element L is coupled to the first operating voltage terminal VL1.

The to-be-driven element L may be a light emitting device, such as a tiny light emitting diode, e.g., a μLED or a Micro LED. The μLED or Micro LED has a size at the micron (μm) scale. The embodiments of the present disclosure are described by taking the case that the to-be-driven element L is a light emitting device and the driving circuit 01 is a driving circuit as an example. It should be understood that the to-be-driven element L may be other fluidic electronic components.

In an embodiment of the present disclosure, the driving element 100 is configured to provide a driving current I and to control an on-state duration of a current path between the first operating voltage terminal VL1 and the second operating voltage terminal VL2.

When the current path is on, a first operating voltage VDD output from the first operating voltage terminal VL1 and a second operating voltage VSS output from the second operating voltage terminal VL2 may provide a potential difference to the current path, so that the driving current I can be transmitted to the light emitting device L through the current path.

It should be noted that the first operating voltage VDD may be a constant high level, and the second operating voltage VSS may be a constant low level.

The light emitting device L is configured to receive the driving current I in the current path and emit light.

Figure 3:
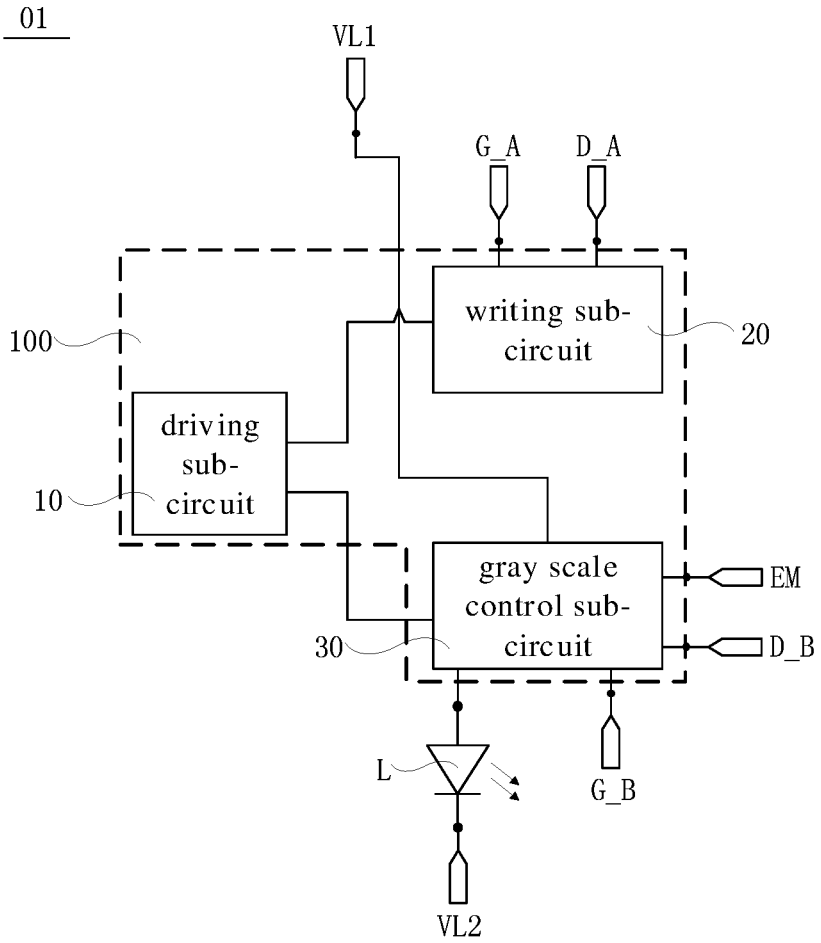
FIG. 3 is a schematic diagram of a specific structure of the driving circuit shown in FIG. 1.
Figure 4:
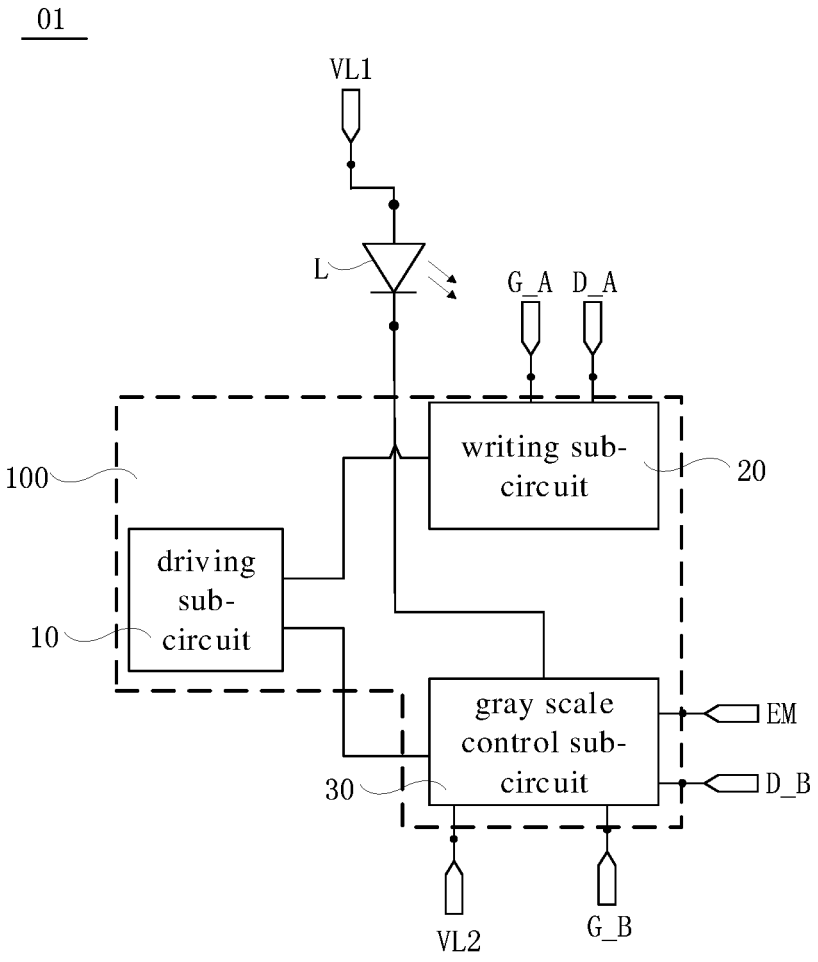
FIG. 4 is a schematic diagram of a specific structure of the driving circuit shown in FIG. 2.

As shown in FIG. 3 or 4, the driving element 100 includes a driving sub-circuit 10, a writing sub-circuit 20, and a gray scale control sub-circuit 30.

Figure 10:
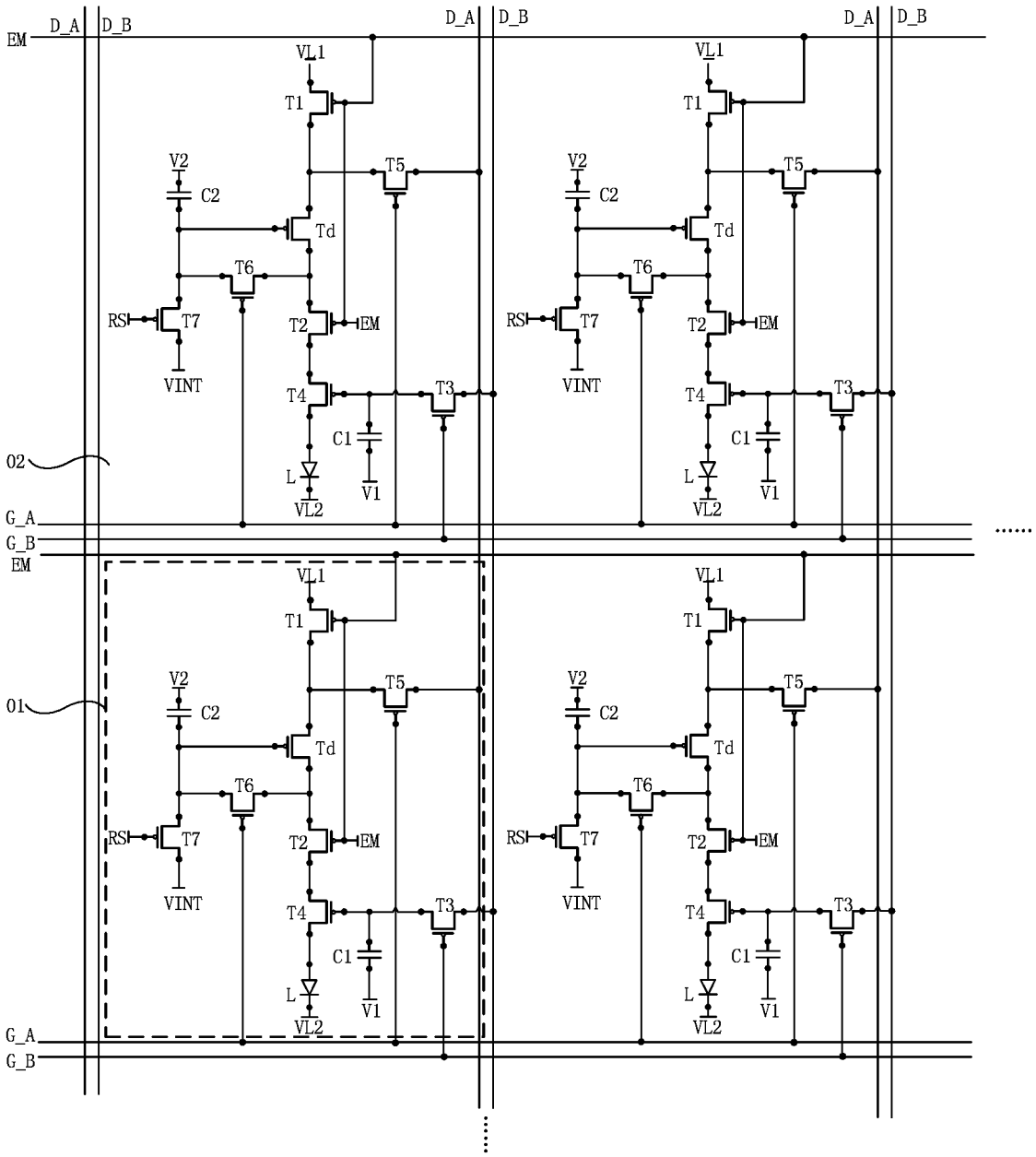
FIG. 10 is a schematic structural diagram of a display panel according to some embodiments of the present disclosure.

The writing sub-circuit 20 is coupled to a first scanning signal terminal (also called a first scanning signal line, as shown in FIG. 10) G_A, a first data signal terminal (also called a first data signal line, as shown in FIG. 10) D_A, and a driving sub-circuit 10. The writing sub-circuit 20 is configured to write a first data voltage Vdata_A provided by the first data signal terminal D_A into the driving sub-circuit 10 under control of the first scanning signal terminal G_A.

The gray scale control sub-circuit 30 is coupled to an emission control signal terminal EM (i.e., a driving control signal terminal), a second scanning signal terminal (also called a second scanning signal line, as shown in FIG. 10) G_B, a second data signal terminal (also called a second data signal line, as shown in FIG. 10) D_B, and the driving sub-circuit 10.

When the driving circuit 01 adopts the structure as shown in FIG. 1, the gray scale control sub-circuit 30 in the driving circuit 01 may be directly coupled to the first operating voltage terminal VL1 and coupled to the second operating voltage terminal VL2 through the light emitting device L, as shown in FIG. 3. Alternatively, when the driving circuit 01 adopts the structure as shown in FIG. 2, the gray scale control sub-circuit 30 in the driving circuit 01 may be coupled to the first operating voltage terminal VL1 through the light emitting device L and directly coupled to the second operating voltage terminal VL2, as shown in FIG. 4. In the case of the driving circuit 01 shown in FIG. 3, the gray scale control sub-circuit 30 is configured to transmit the first operating voltage VDD supplied from the first operating voltage terminal VL1 to the driving sub-circuit 10 under control of the emission control signal terminal EM.

The driving sub-circuit 10 is configured to generate the driving current I according to the first data voltage Vdata_A and the first operating voltage VDD.

The gray scale control sub-circuit 30 is further configured to control the on-state duration of the current path under control of the emission control signal terminal EM, the second scanning signal terminal G_B, and the second data signal terminal D_B.

In summary, the writing sub-circuit 20 can output the first data voltage Vdata_A related to the displayed gray scale to the driving sub-circuit 10, so that the driving sub-circuit 10 can generate the driving current I for driving the light emitting device L to emit light. In addition, the gray scale control sub-circuit 30 can control the on-state duration of the current path generated in the process that the driving current I flows into the light emitting device L, thereby controlling the light emission duration of the light emitting device L. Since the magnitude and the light emission duration of the driving current I affect the effective light emission luminance of the light emitting device L, the effective light emission luminance of the light emitting device L can be controlled by the magnitude of the first data voltage Vdata_A and the gray scale control sub-circuit 30 in one scanning period, so as to achieve the purpose of adjusting the displayed gray scale. According to an embodiment of the present disclosure, since the gray scale control sub-circuit 30 may be disposed in each driving circuit 01, and the gray scale control sub-circuits 30 included in respective driving circuits corresponding to the sub-pixels in the same row are coupled to different data signal lines (i.e., these gray scale control sub-circuits 30 are controlled by the second data voltages Vdata_B independent of each other), the driving circuit 01 according to the embodiments of the present disclosure can directly and individually control the luminance of the light emitting device L (e.g., μLED) in the driving circuit 01. Furthermore, the driving circuit 01 according to the embodiment of the present disclosure can be manufactured on a glass substrate or a transparent resin substrate in a display panel of a display apparatus by a patterning process. When the light emitting device is a μLED, the realization of the μLED display apparatus which has lower cost, simple manufacturing process and can be mass produced can be provided.

The structure of each sub-circuit in the driving circuit 01 will be described in detail below.

Figure 5:
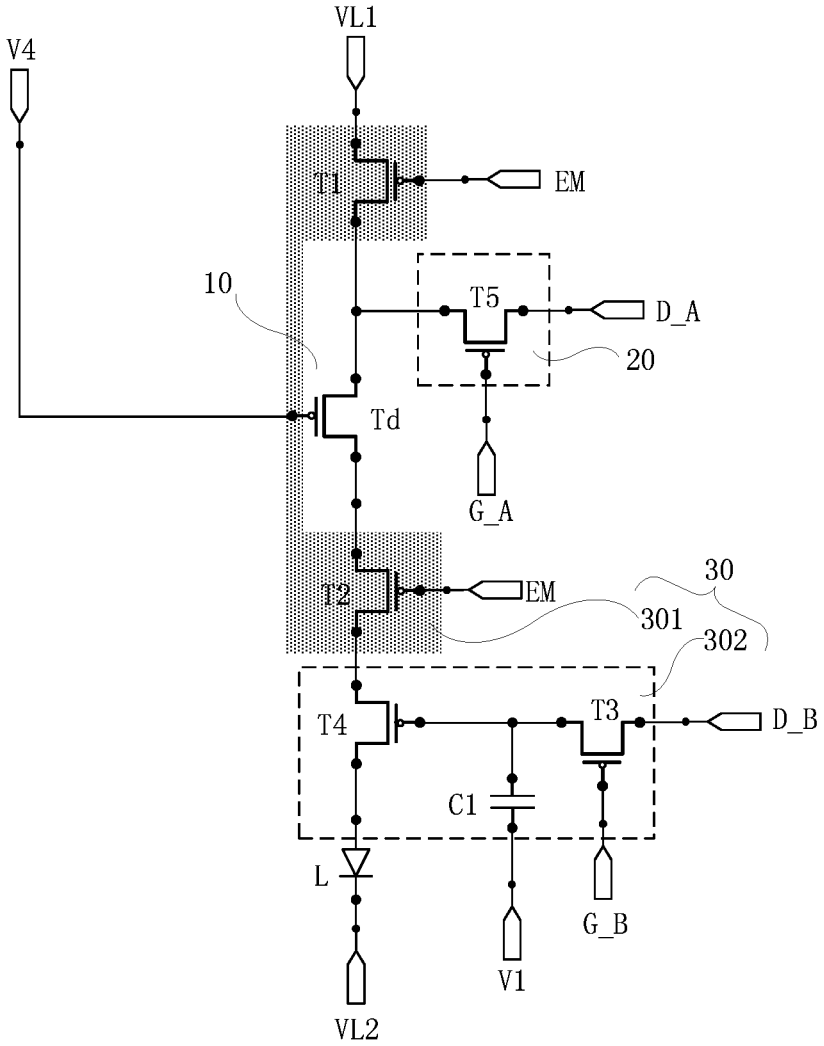
FIG. 5 is a schematic diagram of specific structures of sub-circuits in the driving circuit shown in FIG. 3.

Taking the structure shown in FIG. 3 as an example, the gray-scale control sub-circuit 30 may include a first control sub-circuit 301 and a second control sub-circuit 302, as shown in FIG. 5.

Referring to FIG. 5, the first control sub-circuit 301 is coupled to the emission control signal terminal EM, the driving sub-circuit 10, and the second control sub-circuit 302. The first control sub-circuit 301 is configured to transmit the first operating voltage VDD provided by the first operating voltage terminal VL1 to the driving sub-circuit 10 under control of the emission control signal terminal EM.

The first control sub-circuit 301 is further configured to, under control of the emission control signal terminal EM, transmit the driving current I generated by the driving sub-circuit 10 to the second control sub-circuit 302, and control the on-state duration of the current path.

The second control sub-circuit 302 is further coupled to the second scanning signal terminal G_B and the second data signal terminal D_B. The second control sub-circuit 302 is configured to control whether the current path is on in one scanning period and control a total on-state duration of the current path in a plurality of scanning periods under control of the second scanning signal terminal G_B and the second data signal terminal D_B.

As can be seen from the above, the current path can be on and the driving current I generated by the driving sub-circuit 10 can be outputted to the light emitting device L through the current path, only when the first control sub-circuit 301 and the second control sub-circuit 302 are both at the on state. Thus, the effective light emission luminance of the light emitting device L can be cooperatively controlled by the driving current I, the first control sub-circuit 301 and the second control sub-circuit 302, which increases the factors affecting the effective light emission luminance of the light emitting device L, so that values of the gray scales displayed by the sub-pixel having the driving circuit 01 are more diversified.

According to an embodiment of the present disclosure, as shown in FIG. 5, the first control sub-circuit 301 may include a first transistor T1 and a second transistor T2.

FIG. 5 is an example of the structure shown in FIG. 3, and illustrates the structure of each sub-circuit in FIG. 3. In this case, as shown in FIG. 5, the cathode of the light emitting device L is coupled to the second operating voltage terminal VL2.

A gate electrode of the first transistor T1 is coupled to the emission control signal terminal EM, a first electrode of the first transistor T1 is coupled to the first operating voltage terminal VL1, and a second electrode of the first transistor T1 is coupled to the driving sub-circuit 10.

A gate electrode of the second transistor T2 is coupled to the emission control signal terminal EM, a first electrode of the second transistor T2 is coupled to the driving sub-circuit 10, and a second electrode of the second transistor T2 is coupled to the second control sub-circuit 302.

In addition, the second control sub-circuit 302 is further coupled to a first voltage terminal V1. The first voltage terminal V1 may be a ground terminal GND.

The second control sub-circuit 302 includes a third transistor T3, a fourth transistor T4, and a first capacitor C1.

The third transistor T3 has a gate electrode coupled to the second scanning signal terminal G_B, a first electrode coupled to the second data signal terminal D_B, and a second electrode coupled to a gate electrode of the fourth transistor T4.

One terminal of the first capacitor C1 is coupled to the second electrode of the third transistor T3, and the other terminal of the first capacitor C1 is coupled to the first voltage terminal V1.

As shown in FIG. 5, in a case where the anode of the light emitting device L is coupled to the second control sub-circuit 302 and the cathode of the light emitting device L is coupled to the second operating voltage terminal VL2, a first electrode of the fourth transistor T4 is coupled to the first control sub-circuit 301 and a second electrode of the fourth transistor T4 is coupled to the anode of the light emitting device L.

When the first control sub-circuit 301 is configured as described above, the first electrode of the fourth transistor T4 is coupled to the second electrode of the second transistor T2.

According to another embodiment of the present disclosure, the structure of each sub-circuit in FIG. 4 will be described by taking the structure shown in FIG. 6 as an example.

Figure 6:
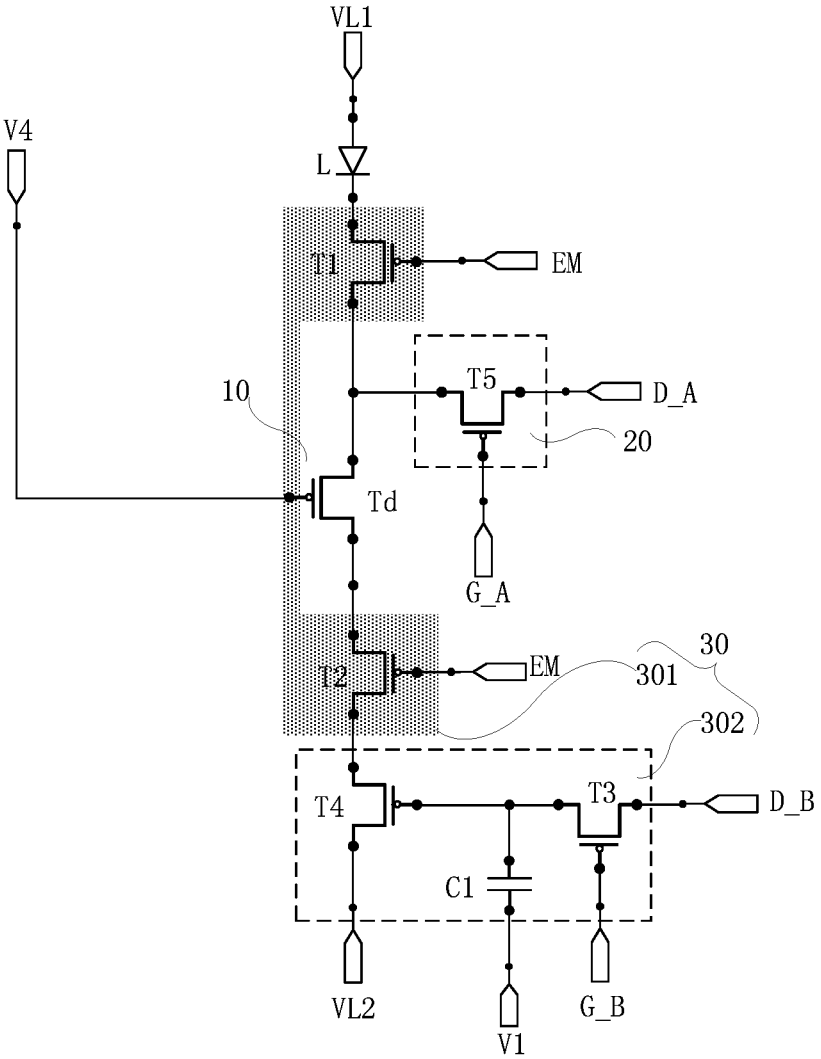
FIG. 6 is a schematic diagram of specific structures of sub-circuits in the driving circuit shown in FIG. 4.

FIG. 6 is a schematic diagram of structures of the sub-circuits in FIG. 4, which are similar to the structures of the sub-circuits in FIG. 5, except that the connection among the light emitting device L, the first control sub-circuit and the second control sub-circuit. Referring to FIGS. 4 and 6, the anode of the light emitting device L is coupled to the first operating voltage terminal VL1, and the cathode of the light emitting device L is coupled to the first electrode of the first transistor T1. The first electrode of the fourth transistor T4 is coupled to the first control sub-circuit 301 and the second electrode thereof is coupled to the second operating voltage terminal VL2.

Figure 7:
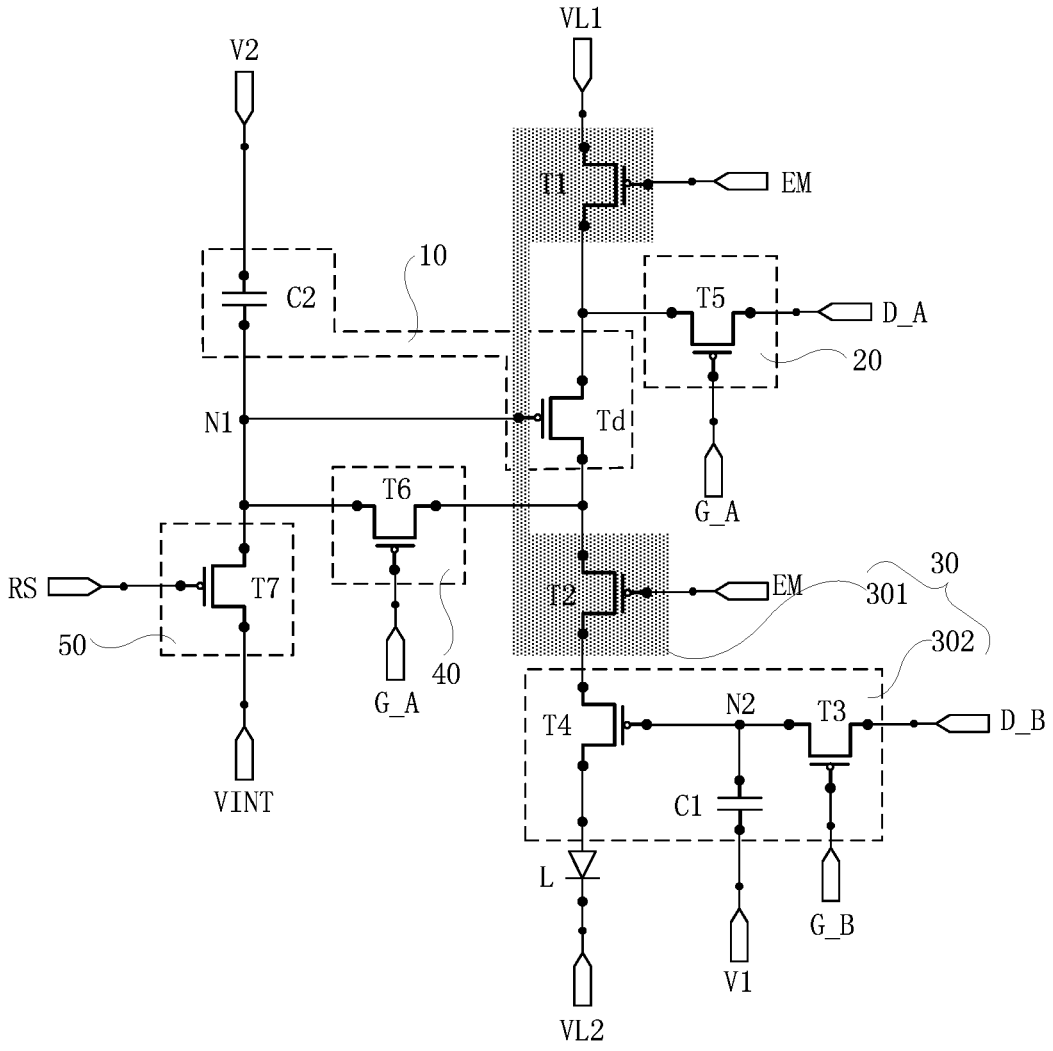
FIG. 7 is a schematic structural diagram of another driving circuit according to some embodiments of the present disclosure.

According to an embodiment of the present disclosure, as shown in FIG. 7, the driving sub-circuit 10 includes a driving transistor Td and a second capacitor C2, a gate electrode of the driving transistor Td is coupled to one terminal of the second capacitor C2, and the other terminal of the second capacitor C2 is coupled to a second voltage terminal V2. The second voltage terminal V2 may be the same as the first voltage terminal V1, and may be the ground terminal GND. Alternatively, since the second voltage terminal V2 is close to the first operating voltage terminal VL1, the second voltage terminal V2 may be coupled to the first operating voltage terminal VL1 to receive the first operating voltage VDD output by the first operating voltage terminal VL1, in order to make circuit layout design simpler.

The gate electrode of the driving transistor Td is coupled to one terminal of the second capacitor C2, the first electrode of the driving transistor Td is coupled to the writing sub-circuit 20, and the second electrode of the driving transistor Td is coupled to the gray scale control sub-circuit 30. When the gray scale control sub-circuit 30 is configured as described above, the second electrode of the driving transistor Td is coupled to the first electrode of the second transistor T2.

According to an embodiment of the present disclosure, the writing sub-circuit 20 includes a fifth transistor T5.

A gate electrode of the fifth transistor T5 is coupled to the first scanning signal terminal G_A, a first electrode of the fifth transistor T5 is coupled to the first data signal terminal D_A, and a second electrode of the fifth transistor T5 is coupled to the driving sub-circuit 10. When the driving sub-circuit 10 is configured as described above, the second electrode of the fifth transistor T5 is coupled to the first electrode of the driving transistor Td. When the driving transistor Td in the driving sub-circuit 10 operates in a saturation region, the driving transistor Td may generate a driving current I according to a gate voltage and a source voltage thereof. As can be derived from the driving current formula $I=K(Vgs-Vth)^2$, the driving current I is affected by the threshold voltage Vth of the driving transistor Td. Since the threshold voltage Vth of the driving transistor Td shifts during the operating process, and the shift amounts of the threshold voltages Vth of the driving transistors Td in different sub-pixels are not necessarily the same, the driving currents I generated by the driving transistors Td in different sub-pixels are different when the same gray scale data is displayed, as a result, the luminance of the light emitting devices L in different sub-pixels is uneven, and the display effect may be affected.

In order to solve the above problem, the driving circuit 01 according to an embodiment of the present disclosure further includes a compensation sub-circuit 40, as shown in FIG. 7.

The compensation sub-circuit 40 is coupled to the first scanning signal terminal G_A and the driving sub-circuit 10. The compensation sub-circuit 40 is configured to compensate the threshold voltage of the driving sub-circuit 10 under control of the first scanning signal terminal G_A. When the driving sub-circuit 10 is configured as described above, the compensation sub-circuit 40 can compensate for the threshold voltage Vth of the driving transistor Td. A specific process of compensating the threshold voltage Vth will be described later.

Illustratively, the compensation sub-circuit 40 may include a sixth transistor T6.

A gate electrode of the sixth transistor T6 is coupled to the first scanning signal terminal G_A, and first and second electrodes of the sixth transistor T6 are coupled to the driving sub-circuit 10. When the driving sub-circuit 10 is configured as described above, the first electrode of the sixth transistor T6 is coupled to the second electrode of the driving transistor Td, and the second electrode of the sixth transistor T6 is coupled to the gate electrode of the driving transistor Td.

In addition, considering that the signal of the previous image frame remaining in the driving sub-circuit 10 may affect the display of the next image frame, the driving circuit 01 according to the embodiment of the present disclosure further includes a reset sub-circuit 50, as shown in FIG. 7.

The reset sub-circuit 50 is coupled to a reset voltage terminal VINT, a reset control signal terminal RS, and the driving sub-circuit 10. The reset sub-circuit 50 is configured to transmit a reset voltage provided by the reset voltage terminal VINT to the driving sub-circuit 10 under control of the reset control signal terminal RS.

The reset sub-circuit 50 includes a seventh transistor T7.

The seventh transistor T7 has a gate electrode coupled to the reset control signal terminal RS, a first electrode coupled to the reset voltage terminal VINT, and a second electrode coupled to the driving sub-circuit 10. When the driving sub-circuit 10 is configured as described above, the second electrode of the seventh transistor T7 is coupled to the gate electrode of the driving transistor Td.

Figure 8:
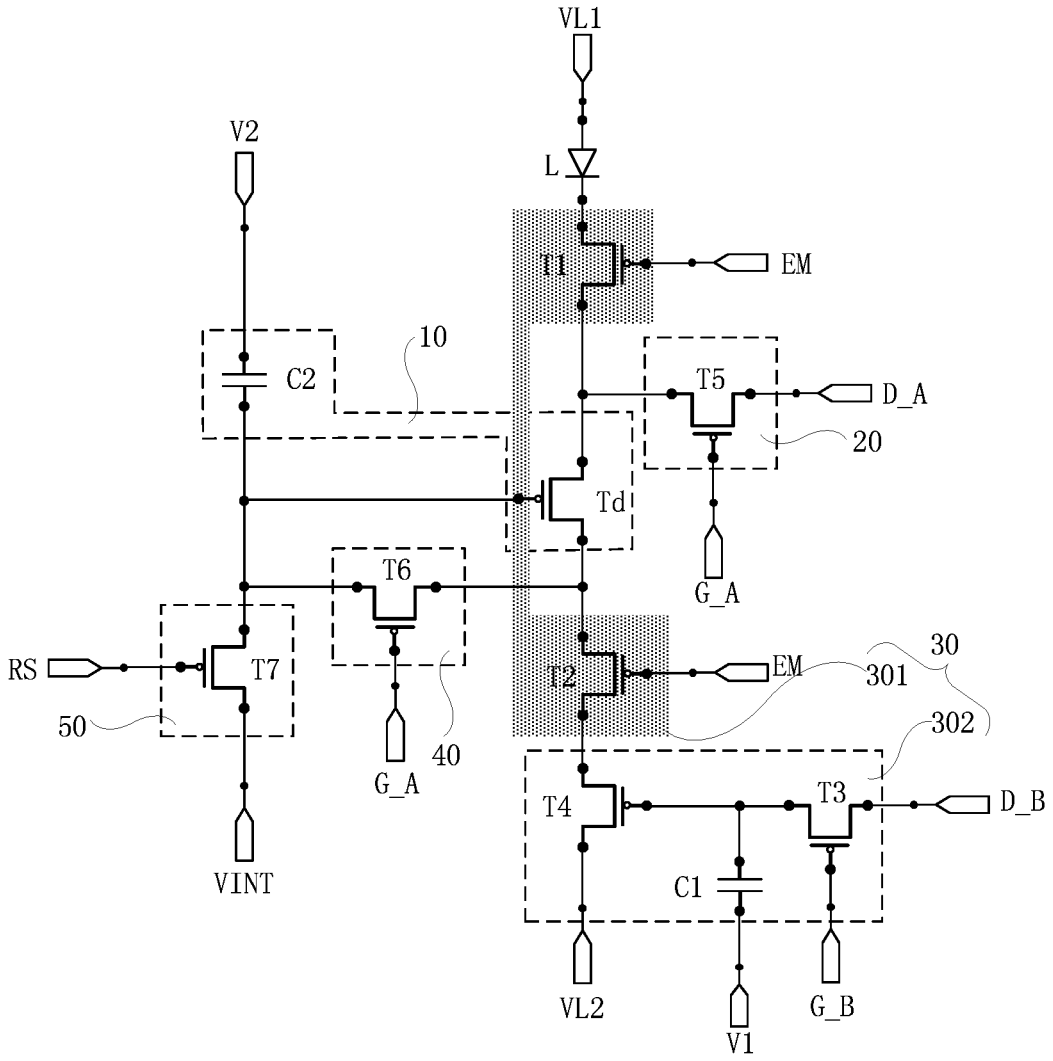
FIG. 8 is a schematic structural diagram of another driving circuit according to some embodiments of the present disclosure.

It should be noted that FIG. 7 illustrates that the driving element 100 and the light emitting device L are coupled as illustrated in FIG. 1. When the driving element 100 and the light emitting device L are coupled as shown in FIG. 2, the specific structures and connection of the compensation sub-circuit 40 and the reset sub-circuit 50 are the same as those described above, and the structure of the driving circuit 01 having the driving sub-circuit 10, the writing sub-circuit 20, the gray scale control sub-circuit 30, the compensation sub-circuit 40, and the reset sub-circuit 50 is shown in FIG. 8.

In addition, in FIGS. 5 to 8, the description is given by taking an example in which all transistors are P-type transistors. In some embodiments of the present disclosure, the transistors in each sub-circuit may also be N-type transistors. The first electrode of the transistor may be a source electrode, and the second electrode of the transistor may be a drain electrode. Alternatively, the first electrode of the transistor may be a drain electrode and the second electrode of the transistor may be a source electrode.

The operation of the driving circuit 01 in one image frame will be described in detail below, by taking the structure of the driving circuit 01 shown in FIG. 7 as an example.

Figure 9:
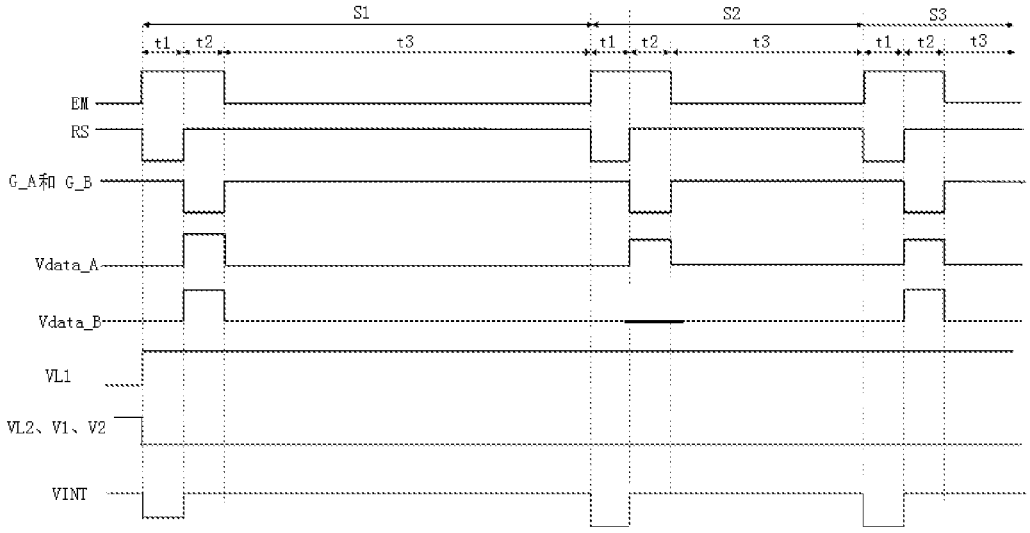
FIG. 9 is a timing signal diagram according to some embodiments of the present disclosure.

In some embodiments of the present disclosure, in order to enable the sub-pixel having the driving circuit 01 to display more gray scales and have a better display effect, the driving circuit 01 may operate in a plurality of scanning periods S within one image frame. For example, as shown in FIG. 9, the description will be given by taking a case in which three scanning periods S1, S2, and S3 are provided in one image frame as an example.

Each scanning period can be divided into three stages: a first stage t1, a second stage t2, and a third stage t3.

Taking a first scanning period S1 as an example, in the first stage t1, a low level is input to the reset control signal terminal RS, the seventh transistor T7 is turned on, and a reset voltage provided by the reset voltage terminal VINT is transmitted to the gate electrode of the driving transistor Td through the seventh transistor T7, so as to reset the gate electrode of the driving transistor Td, thereby preventing the voltage of the previous image frame remaining in the driving transistor Td from affecting the display of the current image frame. At this time, the voltage at a node N1 is the reset voltage provided by the reset voltage terminal VINT.

According to an embodiment of the present disclosure, the reset voltage may be a low level, which makes the driving transistor Td be close to an on state but not turned on, thereby preparing for charging the gate electrode of the driving transistor Td during a subsequent data writing stage, so that the first data voltage Vdata_A can more rapidly charge the gate electrode of the driving transistor Td. Therefore, in the subsequent data writing stage, when different data voltages are written into the driving transistors, the writing time of the data voltage can be reduced, so that the response time, as well as the writing time of the data voltage, of all the driving transistors Td can be almost the same for all the driving circuits of the whole display panel, and the display uniformity can be improved for the whole display panel.

The first stage t1 may be referred to as a reset stage.

In the second stage t2, a low level is input to the first and second scanning signal terminals G_A and G_B. The fifth and sixth transistors T5 and T6 are turned on under control of the first scanning signal terminal G_A. The first data voltage Vdata_A supplied from the first data signal terminal D_A is transmitted to the first electrode of the driving transistor Td through the fifth transistor T5.

When the sixth transistor T6 is turned on, the gate electrode and the second electrode of the driving transistor Td are electrically coupled, so that the driving transistor Td serves as a diode. At this time, the first data voltage Vdata_A charges the gate electrode of the driving transistor Td until the driving transistor Td is turned off. When the driving transistor Td is turned off, the gate-source voltage Vgs of the driving transistor Td is equal to Vth, that is, Vg−Vs=Vth. At this time, the voltage at the gate electrode of the driving transistor Td (i.e., the voltage at the node N1) may be Vg=Vs+Vth=Vdata_A+Vth. In this case, the first data voltage Vdata_A is written to the gate electrode of the driving transistor Td.

In addition, the third transistor T3 is turned on under control of the second scanning signal terminal G_B, and the second data voltage Vdata_B provided from the second data signal terminal D_B is transmitted to the gate electrode of the fourth transistor T4 through the third transistor T3. The voltage at the node N2 is Vdata_B.

The potentials at the node N1 and the node N2 remain constant under action of the first capacitor C1 and the second capacitor C2, until a low level is input to the first scanning signal terminal G_A and the second scanning signal terminal G_B again.

The second stage t2 may be a data writing stage.

In the third stage t3, as shown in FIG. 9, the emission control signal terminal EM provides a low level, and the first transistor T1 and the second transistor T2 are turned on.

In addition, the second data voltage Vdata_B provided by the second data signal terminal D_B has two states of a high level (VGH) and a low level (VGL). It may be configured that the fourth transistor T4 is turned off when the gate electrode of the fourth transistor T4 receives a high level, and the fourth transistor T4 is turned on when the gate electrode of the fourth transistor T4 receives a low level.

In FIG. 9, in the third stage T3, the second data voltage Vdata_B is at a low level, and at this time, the voltage at the second scanning signal terminal G_B changes from a low level to a high level, and the third transistor T3 is turned off. However, due to the first capacitor C1, the potential at the node N2 still remains at the high level as in the second stage t2, and thus the fourth transistor T4 is turned off, and the light emitting device L does not emit light at this time. Therefore, the light emission duration of the light emitting device in one image frame can be reduced as a whole, by controlling the light emitting device L not to emit light in the scanning period.

Alternatively, in contrast to the timing diagram shown in FIG. 9, Vdata_B may be set to a low level at the second period t2, to cause the fourth transistor T4 to be turned on in the third stage t3, and in this case, the current path between the first operating voltage terminal VL1 and the second operating voltage terminal VL2 is on. At this time, the driving current I generated by the driving transistor Td operating in the saturation region is transmitted to the light emitting device L through the current path, so that the light emitting device L emits light.

The drive current I satisfies: $I=K(Vgs-Vth)^2=K(Vg-Vs-Vth)^2=K(Vdata_A+Vth-VDD-Vth)^2=K(Vdata_A-VDD)^2$.

where K=1/2Cox(μW/L), Cox, μ, W, and L are channel capacitance per unit area, channel mobility, channel width, and channel length of the driving transistor Td, respectively. Thus K is a constant.

As can be seen from the formula of the driving current I, the driving current I is independent of the threshold voltage Vth of the driving transistor Td. Therefore, the magnitude of the driving current I is not changed due to the shift of the threshold voltage Vth of the driving transistor Td.

The third stage t3 may be a light emitting stage.

The operation of the driving circuit 01 in the first scanning period S1 is described above. The operation of the driving circuit 01 in the remaining scanning periods is the same as that described above, and will not be described herein.

The difference is that, in one aspect, the magnitude of the first data voltage Vdata_A supplied from the first data signal terminal D_A may be changed to change the magnitude of the driving current I flowing through the light emitting device L, and in another aspect, the magnitude of the second data voltage Vdata_B supplied from the second data signal terminal D_B may also be changed. For example, referring to FIG. 9, Vdata_B may be set to a low level at the second stage t2 of the second scanning period S2, thereby causing the fourth transistor T4 to be turned on in the second scanning period S2, and thus the light emitting device L emits light in the second scanning period S2 to change effective light emission luminance of the light emitting device L in one image frame. Therefore, Vdata_B can determine when to transmit the driving current I to the light emitting device L. In yet another aspect, the duration during which the emission control signal terminal EM supplies the low level may be controlled. For example, the duty ratio of the signal supplied from the emission control signal terminal EM may be controlled to control the on-state durations of the first transistor T1 and the second transistor T2, thereby controlling the on-state duration of the current path through which the driving current I flows.

In summary, the effective light emission luminance of the light emitting device L in the driving circuit 01 in an image frame can be determined by a plurality of factors, such as the number of scanning periods in the image frame, the duration of each scanning period, the first data voltage Vdata_A, the second data voltage Vdata_B, and the emission control signal provided by the emission control signal terminal EM, so that the number of the gray scales displayed by the sub-pixel having the driving circuit 01 can be increased, and the display panel can display a richer and finer image.

In addition, as shown in FIG. 7, the gate electrodes of the fifth transistor T5 and the sixth transistor T6 are coupled to the first scanning signal terminal G_A, and the gate electrode of the third transistor T3 is coupled to the second scanning signal terminal G_B. FIG. 9 illustrates an example in which signals input to the first scanning signal terminal G_A and the second scanning signal terminal G_B are the same.

Figure 12:
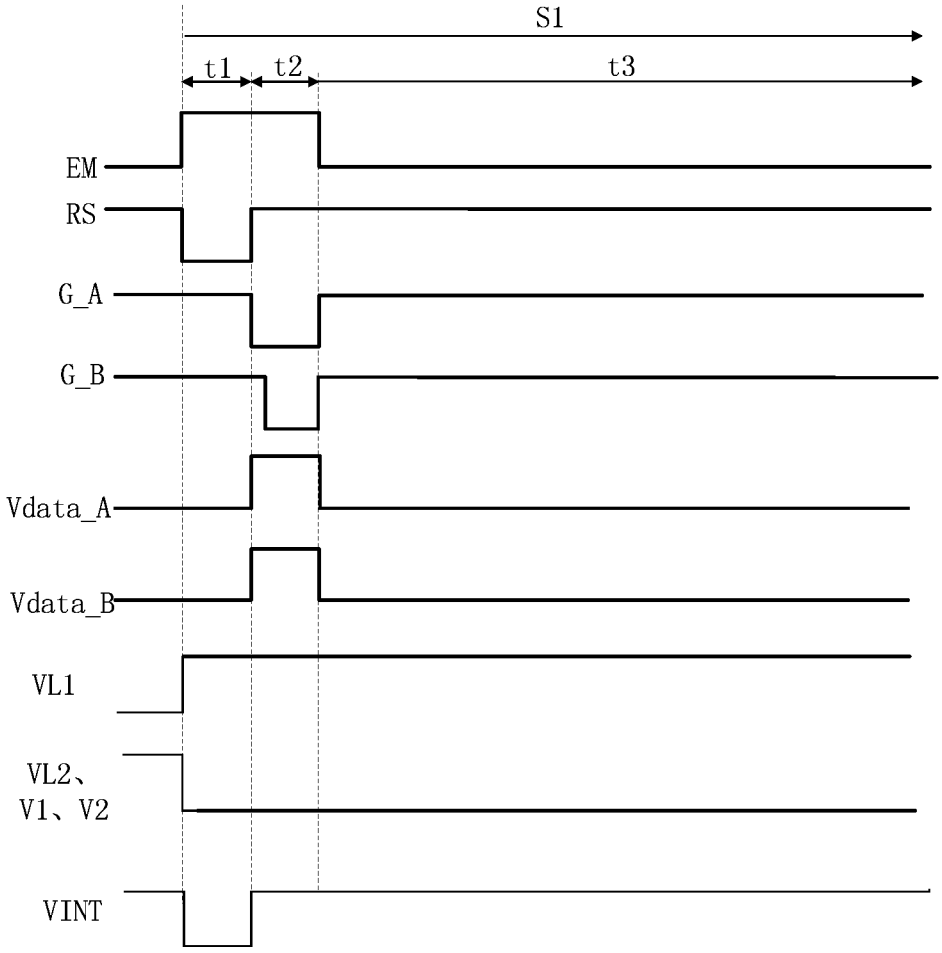
FIG. 12 is another timing signal diagram according to some embodiments of the present disclosure.

In some embodiments of the present disclosure, as shown in FIG. 12, during one scanning period S, the active signal input from the second scanning signal terminal G_B may be delayed. For example, during the second stage t2, the active signal input from the second scanning signal terminal G_B is delayed with respect to the active signal input from the first scanning signal terminal G_A.

The active signal is a level signal, for example, a low level, which can make the sub-circuit receiving the active signal in an on state. In this case, the time when the gray scale control sub-circuit 30 receiving the active signal from the second scanning signal terminal G_B is turned on is later than the time when the writing sub-circuit 20 receiving the active signal from the first scanning signal terminal G_A is turned on.

Further, when the sub-circuit includes a transistor, the active signal refers to a level signal that can cause the transistor controlled by the active signal to be turned on. For example, when the gray scale control sub-circuit 30 includes the third transistor T3, the writing sub-circuit 20 includes the fifth transistor T5, and the compensation sub-circuit 40 includes the sixth transistor T6, the time when the fifth transistor T5 and the sixth transistor T6 controlled by the first scanning signal terminal G_A are turned on is earlier than the time when the third transistor T3 controlled by the second scanning signal terminal G_B is turned on. When the transistor is a P-type transistor, the active signal is a low level.

In this way, the time when the fourth transistor T4 is turned on may be delayed, thereby preventing the leakage current generated by the second transistor T2 from flowing into the light emitting device L through the fourth transistor T4 to cause the phenomenon of false light emission. That is, according to the embodiment of the present disclosure, after the state that the first data voltage Vdata_A provided by the first data signal terminal D_A is written into the driving transistor Td is stabilized, and the driving current I generated by the driving transistor Td is stabilized, the third transistor T3 is turned on, and the fourth transistor T4 is controlled to be turned on, so as to transmit the stabilized driving current I to the light emitting device L, thereby making the luminance of the light emitting device L stable.

The above is a description taking the structure shown in FIG. 7 as an example, and the operating process of the driving circuit 01 shown in FIG. 8 is the same as the above, and will not be described herein.

Some embodiments of the present disclosure provide a display apparatus including a display panel, a display area of the display panel has a plurality of sub-pixels 02 as shown in FIG. 10, and at least one of the sub-pixels 02 is provided therein with any one of the driving circuits 01 as described above.

The sub-pixels 02 may be defined by the first scanning signal lines G_A and the first data signal lines D_A arranged in the horizontal and vertical directions to intersect each other. In addition, the second scanning signal line G_B may be disposed parallel to the first scanning signal line G_A, and the second data signal line D_B may be disposed parallel to the first data signal line D_A.

As can be seen from FIG. 10, the first transistors T1 in the driving circuits 01 of the sub-pixels located in the same row are coupled to the same emission control signal terminal EM. In this case, when the emission control signal terminal EM supplies an active signal, for example, a low level as shown in FIG. 9, each of the first transistors T1 and the second transistors T2 in the same row is turned on.

Based on this, in order to enable the luminance of different sub-pixels in the same row to be controlled individually, the third transistor T3 can be controlled to be turned on by inputting an active signal through the second scanning signal terminal G_B, and then, after the third transistor T3 is turned on, and when the second data voltage Vdata_B provided through the second data signal terminal D_B is an active signal, the fourth transistor T4 is controlled to be turned on, so that the current path between the first operating voltage terminal VL1 and the second operating voltage terminal VL2 is on.

The driving current I generated by the driving transistor Td can be transmitted to the light emitting device L through the current path. The longer the duration that this current path is on, the higher the effective light emission luminance of the light emitting device L in a scanning period S. In addition, the magnitude of the driving current I can be adjusted by adjusting the magnitude of the first data voltage Vdata_A provided by the first data signal terminal D_A. The larger the drive current I, the higher the effective light emission luminance of the light emitting device L in a scanning period S.

According to the embodiment of the present disclosure, as shown in FIG. 9, there are three scanning periods S1, S2, and S3 within one image frame. The third stages t3 in the three scanning periods are different from each other. Accordingly, one or more scanning periods may be selected according to the desired light emission duration of the light emitting device such that the light emitting device emits light at the third stage t3 within the one or more scanning periods, thereby enabling 8 different gray scales. According to another embodiment of the present disclosure, the third stages in the plurality of scanning periods of one image frame may be identical to each other. Therefore, one or more scanning periods may be selected according to the desired light emission duration of the light emitting device such that the light emitting device emits light at the third stage t3 within the one or more scanning periods to change the light emission duration of the light emitting device, thereby enabling 4 different gray scales.

It can be seen that, under the condition that there are a plurality of scanning periods in one image frame and the lengths of the scanning periods are different from one another, the adjustable ranges of the light emission duration and the effective light emission luminance of the light-emitting device can be enlarged, and the number of the gray scales which can be displayed by the display panel is enriched.

In summary, conventionally, under the control of the emission control signal provided by the emission control signal terminal EM, all the sub-pixels in the driving circuits 01 in the same row can emit light simultaneously, but the light emission luminance and the light emission duration of each sub-pixel cannot be controlled individually. However, according to the driving circuit provided by the present disclosure, the individual adjustment of the light emission luminance of a single sub-pixel can be realized under the cooperation of the emission control signal terminal EM, the first scanning signal terminal G_A, the second scanning signal terminal G_B, the first data signal terminal D_A, and the second data signal terminal D_B.

It should be noted that the display apparatus may be any product or component with a display function, such as a display, a television, a digital photo frame, a mobile phone, or a tablet computer. The display apparatus can achieve the same technical effects as the driving circuit 01 provided in the foregoing embodiments, and details will not be described herein.

Some embodiments of the present disclosure provide a method for driving the driving circuit 01 as described above, and the driving circuit operates in a plurality of scanning periods within an image frame.

The gray scale control sub-circuit 30 in the driving circuit 01 includes a first control sub-circuit 301 and a second control sub-circuit 302.

Figure 11:
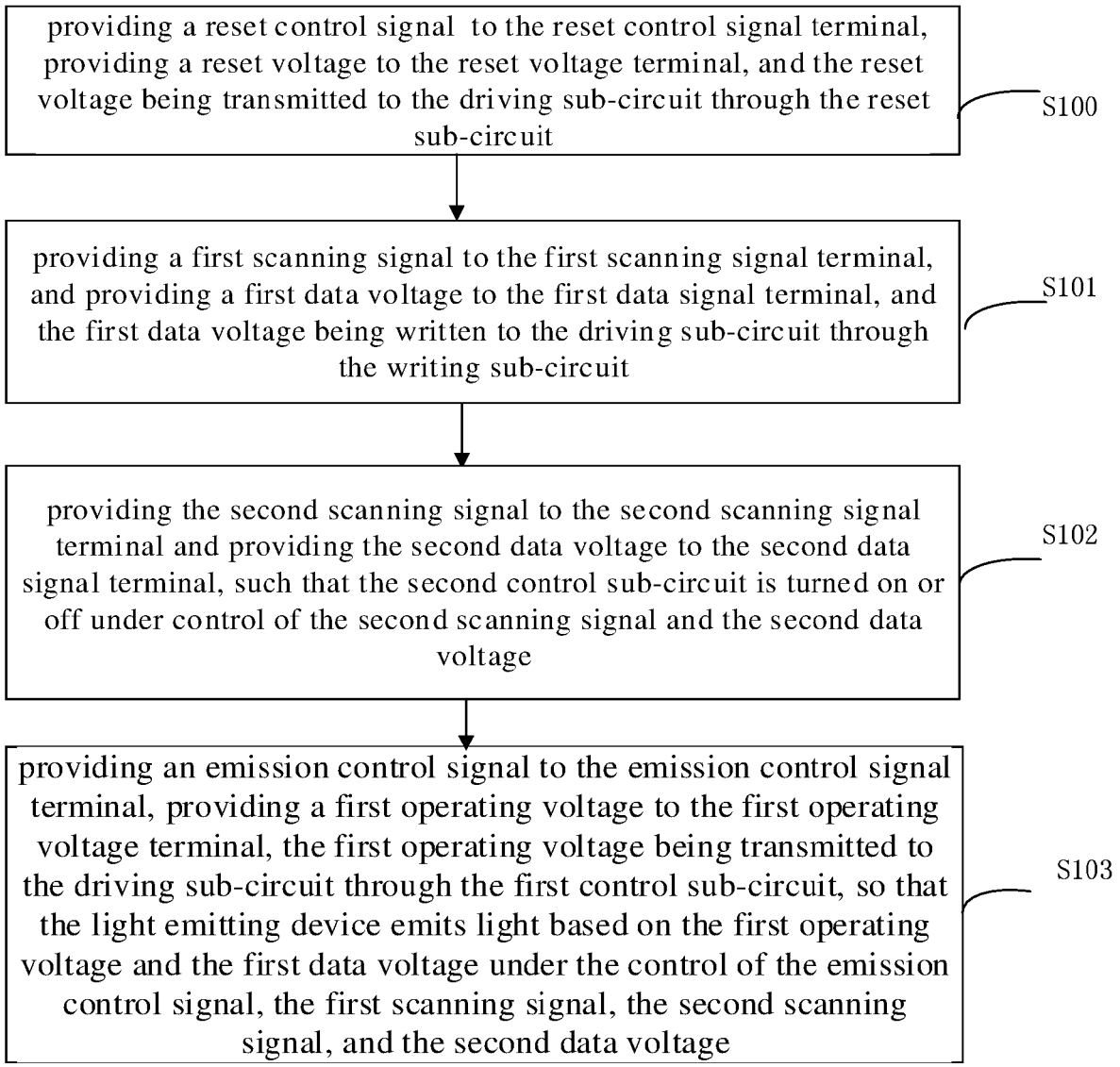
FIG. 11 is a flowchart of a driving method of a driving circuit according to some embodiments of the present disclosure.

In one scanning period S (e.g., the first scanning period S1), the method for driving the driving circuit includes steps S100 to S103 as shown in FIG. 11.

Step S101 includes providing a first scanning signal to the first scanning signal terminal G_A, and providing a first data voltage Vdata_A to the first data signal terminal D_A, and the first data voltage Vdata_A is written to the driving sub-circuit 10 through the writing sub-circuit 20.

As shown in FIG. 9, in one scanning period S, the signal provided by the first scanning signal terminal G_A has two states of a high level state and a low level state. In the embodiment of the present disclosure, the low level input into the first scanning signal terminal G_A may serve as an active signal for turning on the writing sub-circuit 20. When the high level is input into the first scanning signal terminal G_A, the writing sub-circuit 20 is turned off.

Step S102 includes providing the second scanning signal to the second scanning signal terminal G_B and providing the second data voltage Vdata_B to the second data signal terminal D_B, such that the second control sub-circuit 302 is turned on or off under control of the second scanning signal and the second data voltage Vdata_B.

By controlling the on-state durations of the first control sub-circuit 301 and the second control sub-circuit 302, the purpose of controlling the on-state duration of the current path can be achieved.

The second scanning signal terminal G_B and the second data voltage terminal D_B, as shown in FIG. 9, have two states of a high level and a low level. In the embodiment of the present disclosure, the low level input into the second scanning signal terminal G_B and the second data voltage terminal D_B may serve as an active signal for turning on the second control sub-circuit 302. In other states, the second control sub-circuit 302 is turned off.

It should be noted steps S101 and S102 may be performed in the second stage t2 in a scanning period shown in FIG. 9.

In addition, in the case where the driving circuit 01 further includes the compensation sub-circuit 40, when the first scanning signal is input to the first scanning signal terminal G_A in the second stage t2, the compensation sub-circuit 40 is turned on, thereby compensating for the threshold voltage Vth of the driving transistor Td in the driving sub-circuit 10.

Step S103 includes providing an emission control signal to the emission control signal terminal EM, and the first operating voltage VDD supplied from the first operating voltage terminal VL1 is transmitted to the driving sub-circuit 10 through the first control sub-circuit 301, so that the light emitting device L emits light based on the first operating voltage VDD and the first data voltage Vdata_A under the control of the emission control signal, the first scanning signal, the second scanning signal, and the second data voltage Vdata_B. The emission control signal terminal EM, as shown in FIG. 9, has two states of a high level and a low level. In the embodiments of the present disclosure, the low level provided by the emission control signal terminal EM may serve as an active signal for turning on the first control sub-circuit 301. When the emission control signal terminal EM provides a high level, the first control sub-circuit 301 is turned off.

In an embodiment, the driving sub-circuit 10 generates the driving current I according to the first data voltage Vdata_A and the first operating voltage VDD. The driving current I is transmitted to the second control sub-circuit 302 through the first control sub-circuit 301. Since the first control sub-circuit 301 and the second control sub-circuit 302 are both turned on, the current path between the first operating voltage terminal VL1 and the second operating voltage terminal VL2 is on, and the driving current I is transmitted to the light emitting device L through the current path. The light emitting device L receives the driving current I in the current path and emits light.

It should be noted that step S103 may be performed in the third stage t3 in the scanning period shown in FIG. 9.

In addition, in the case where the driving circuit 10 further includes the reset sub-circuit 50, the method for driving the driving circuit further includes step S100 as shown in FIG. 11, prior to step S101.

In step S100, a reset control signal is provided to the reset control signal terminal RS, and a reset voltage is provided to the reset voltage terminal VINT, and the reset voltage is transmitted to the driving sub-circuit 10 through the reset sub-circuit 50.

The reset control signal terminal RS, as shown in FIG. 9, has two states of a high level and a low level. In the embodiment of the present disclosure, the low level input into the reset control signal terminal RS may serve as an active signal for turning on the reset sub-circuit 50. When the reset control signal terminal RS provides a high level, the reset sub-circuit 50 is turned off.

The gate electrode of the driving transistor Td in the driving sub-circuit 10 can be reset by step S100.

Step S100 may be performed at the first stage t1 in a scanning period as shown in FIG. 9.

It should be noted that, when the structure of each sub-circuit in the driving circuit 10 is as shown in FIG. 7 or FIG. 8, the method for driving the driving circuit 10 has been explained in detail in the description regarding the operating process of the driving circuit 10 in the foregoing embodiment, and will not be described here. In addition, the method for driving the driving circuit has the same technical effects as the driving circuit provided in the foregoing embodiment, and will not be described herein.

In addition, in order to enable the second control sub-circuit 302 to be turned on after the first data voltage Vdata_A is steadily written into the driving sub-circuit 10 through the writing sub-circuit 20, in an embodiment, as shown in FIG. 12, in the second stage t2 of a scanning period S, the time when the second scanning signal terminal G_B provides the active signal is later than the time when the first scanning signal terminal G_A provides the active signal. Therefore, after the driving current I generated by the driving sub-circuit 10 is stable, the second control sub-circuit 302 is turned on to cause the current path in an on state. The active signal has been described above and will not be described here.

In addition, in the case where the driving sub-circuit 10 includes the driving transistor Td and the second capacitor C2, the gate electrode of the driving transistor Td is coupled to one terminal of the second capacitor C2, and the other terminal of the second capacitor C2 is coupled to the second voltage terminal V2, since the second voltage terminal V2 is close to the first operating voltage terminal VL1, the voltage input to the second voltage terminal V2 is the same as the voltage input to the first operating voltage terminal VL1 in order to make the circuit layout design simpler. In this way, the first operating voltage terminal VL1 can be electrically coupled to the second voltage terminal V2. When the driving sub-circuit 10 operates, the first operating voltage VDD provided by the first operating voltage terminal VL1 may be transmitted to the second voltage terminal V2.

Figure 13:
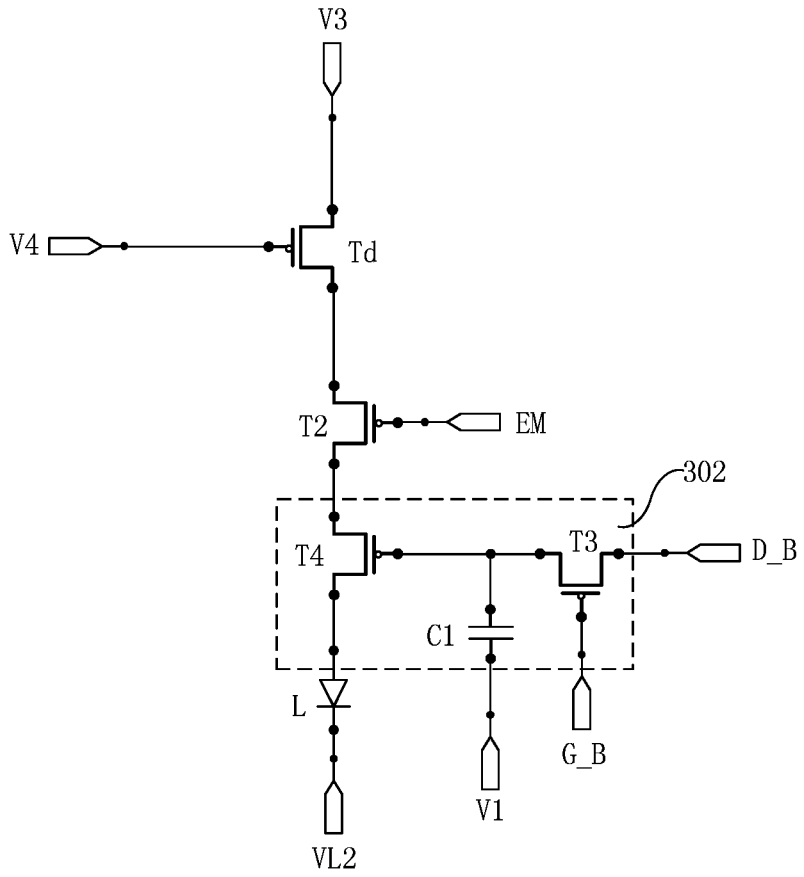
FIG. 13 is a schematic diagram of specific structures of sub-circuits in a driving circuit according to another embodiment.

According to another embodiment of the present disclosure, as shown in FIG. 13, the driving element 100 may only include the second gray scale control sub-circuit 302, the driving transistor Td, and the second transistor T2. It can be understood that the driving transistor Td may generate a driving current for driving the light emitting device L according to a source signal provided from a third voltage terminal V3 and a gate signal provided from a fourth voltage terminal V4. The driving duration of the light emitting device L may be controlled by the second transistor T2 and the second control sub-circuit 302.

Figure 14:
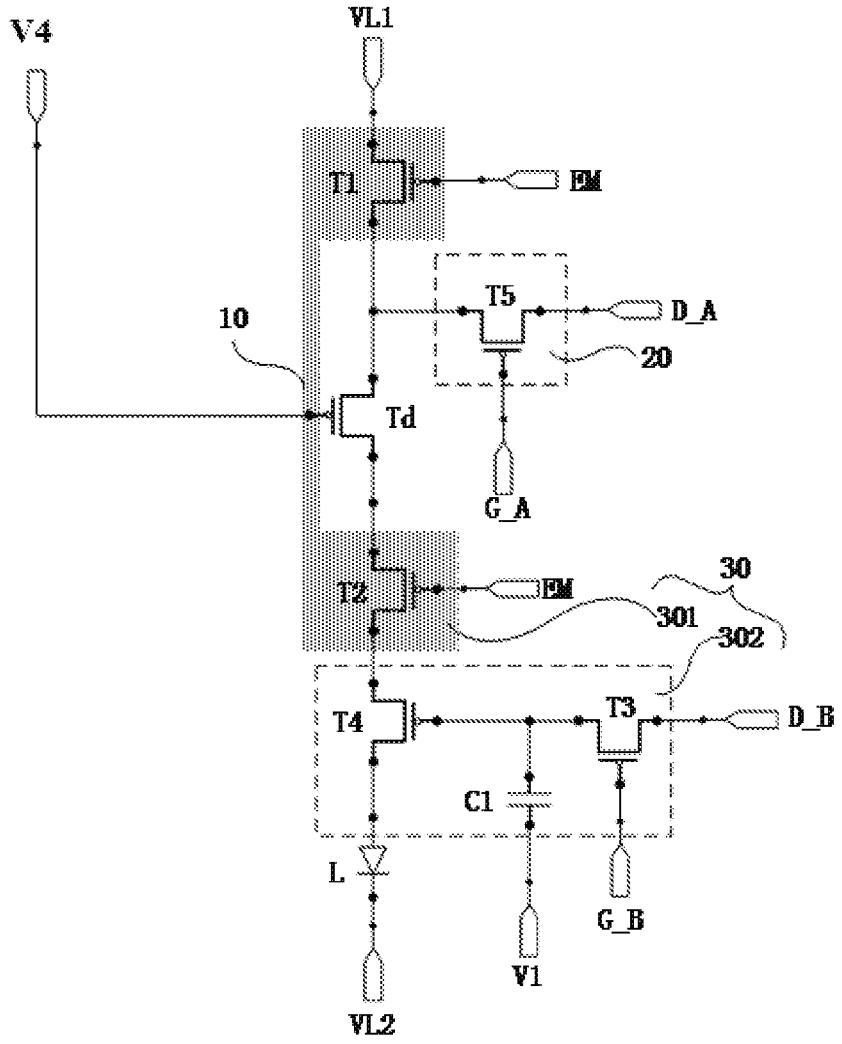
FIG. 14 is a schematic diagram of specific structures of sub-circuits in a driving circuit according to another embodiment.

Referring to FIG. 14, according to an embodiment of the present disclosure, the driving sub-circuit 10 may only include the driving transistor Td having a gate electrode coupled to the fourth voltage terminal V4, a first electrode coupled to the writing sub-circuit, and a second electrode coupled to the gray scale control sub-circuit. The fourth voltage terminal V4 is configured to provide a suitable voltage signal to the gate electrode of the driving transistor Td to turn on the driving transistor Td.

The above description is only for the specific embodiments of the present disclosure, but the scope of the present disclosure is not limited thereto, and changes or substitutions that can be easily conceived by any person skilled in the art within the technical scope of the present disclosure should be within the scope of the present disclosure. Therefore, the protection scope of the present disclosure shall be subject to the protection scope of the claims.

The invention claimed is:

1. A driving circuit, comprising a driving element for driving a to-be-driven element, wherein the driving element and the to-be-driven element are coupled in series between a first operating voltage terminal and a second operating voltage terminal; and the driving element is configured to provide a driving signal to the to-be-driven element and control an on-state duration of a current path between the first operating voltage terminal and the second operating voltage terminal;

the driving element comprises a driving sub-circuit, a writing sub-circuit and a gray scale control sub-circuit;

the writing sub-circuit is coupled to a first scanning signal terminal, a first data signal terminal and the driving sub-circuit; and the writing sub-circuit is configured to write a first data voltage provided by the first data signal terminal into the driving sub-circuit under control of the first scanning signal terminal;

the gray scale control sub-circuit is coupled to a driving control signal terminal, a second scanning signal terminal, a second data signal terminal and the driving sub-circuit;

the gray scale control sub-circuit is configured to transmit a first operating voltage provided by the first operating voltage terminal to the driving sub-circuit under control of the driving control signal terminal;

the driving sub-circuit is configured to generate the driving signal according to the first data voltage and the first operating voltage; and the gray scale control sub-circuit is further configured to control the on-state duration of the current path under control of the driving control signal terminal, the second scanning signal terminal, and the second data signal terminal.

2. The driving circuit of claim 1, wherein the gray scale control sub-circuit comprises a first control sub-circuit and a second control sub-circuit;

the first control sub-circuit is coupled to the driving control signal terminal, the driving sub-circuit and the second control sub-circuit; and the first control sub-circuit is configured to transmit the first operating voltage provided by the first operating voltage terminal to the driving sub-circuit under control of the driving control signal terminal;

the first control sub-circuit is further configured to, under control of the driving control signal terminal, transmit a driving current generated by the driving sub-circuit to the second control sub-circuit, and control the on-state duration of the current path; and the second control sub-circuit is further coupled to the second scanning signal terminal and the second data signal terminal; and the second control sub-circuit is configured to control the on-state duration of the current path under control of the second scanning signal terminal and the second data signal terminal.

3. The driving circuit of claim 2, wherein the first control sub-circuit comprises a first transistor and a second transistor;

an anode of the to-be-driven element is coupled to the second control sub-circuit, a cathode of the to-be-driven element is coupled to the second operating voltage terminal; a gate electrode of the first transistor is coupled to the driving control signal terminal, a first electrode of the first transistor is coupled to the first operating voltage terminal, and a second electrode of the first transistor is coupled to the driving sub-circuit; and a gate electrode of the second transistor is coupled to the driving control signal terminal, a first electrode of the second transistor is coupled to the driving sub-circuit, and a second electrode of the second transistor is coupled to the second control sub-circuit.

4. The driving circuit of claim 2, wherein the first control sub-circuit comprises a first transistor and a second transistor;

an anode of the to-be-driven element is coupled to the first operating voltage terminal; a gate electrode of the first transistor is coupled to the driving control signal terminal, a first electrode of the first transistor is coupled to a cathode of the to-be-driven element, and a second electrode of the first transistor is coupled to the driving sub-circuit; and a gate electrode of the second transistor is coupled to the driving control signal terminal, a first electrode of the second transistor is coupled to the driving sub-circuit, and a second electrode of the second transistor is coupled to the second control sub-circuit.

5. The driving circuit of claim 2, wherein the second control sub-circuit is further coupled to a first voltage terminal; the second control sub-circuit comprises a third transistor, a fourth transistor and a first capacitor;

a gate electrode of the third transistor is coupled to the second scanning signal terminal, a first electrode of the third transistor is coupled to the second data signal terminal, and a second electrode of the third transistor is coupled to a gate electrode of the fourth transistor;

one terminal of the first capacitor is coupled to the second electrode of the third transistor, and the other terminal of the first capacitor is coupled to the first voltage terminal; and a cathode of the to-be-driven element is coupled to the second operating voltage terminal; a first electrode of the fourth transistor is coupled to the first control sub-circuit, and a second electrode of the fourth transistor is coupled to an anode of the to-be-driven element.

6. The driving circuit of claim 2, wherein the second control sub-circuit is further coupled to a first voltage terminal; the second control sub-circuit comprises a third transistor, a fourth transistor and a first capacitor;

a gate electrode of the third transistor is coupled to the second scanning signal terminal, a first electrode of the third transistor is coupled to the second data signal terminal, and a second electrode of the third transistor is coupled to a gate electrode of the fourth transistor;

one terminal of the first capacitor is coupled to the second electrode of the third transistor, and the other terminal of the first capacitor is coupled to the first voltage terminal; and an anode of the to-be-driven element is coupled to the first operating voltage terminal, a cathode of the to-be-driven element is coupled to the first control sub-circuit; a first electrode of the fourth transistor is coupled to the first control sub-circuit, and a second electrode of the fourth transistor is coupled to the second operating voltage terminal.

7. The driving circuit of claim 1, wherein the driving circuit further comprises a compensation sub-circuit;

the compensation sub-circuit is coupled to the first scanning signal terminal and the driving sub-circuit; and the compensation sub-circuit is configured to compensate a threshold voltage of the driving sub-circuit under control of the first scanning signal terminal.

8. The driving circuit of claim 7, wherein the driving sub-circuit is further coupled to a second voltage terminal, and the driving sub-circuit comprises a driving transistor and a second capacitor;

a gate electrode of the driving transistor is coupled to one terminal of the second capacitor, a first electrode of the driving transistor is coupled to the writing sub-circuit, and a second electrode of the driving transistor is coupled to the gray scale control sub-circuit; and the other terminal of the second capacitor is coupled to the second voltage terminal.

9. The driving circuit of claim 7, wherein the compensation sub-circuit comprises a sixth transistor; and a gate electrode of the sixth transistor is coupled to the first scanning signal terminal, and first and second electrodes of the sixth transistor are coupled to the driving sub-circuit.

10. The driving circuit of claim 1, wherein the driving circuit further comprises a reset sub-circuit;

the reset sub-circuit is coupled to a reset voltage terminal, a reset control signal terminal and the driving sub-circuit; and the reset sub-circuit is configured to transmit a reset voltage provided by the reset voltage terminal to the driving sub-circuit under control of the reset control signal terminal.

11. The driving circuit of claim 10, wherein the reset sub-circuit comprises a seventh transistor; and a gate electrode of the seventh transistor is coupled to the reset control signal terminal, a first electrode of the seventh transistor is coupled to the reset voltage terminal, and a second electrode of the seventh transistor is coupled to the driving sub-circuit.

12. The driving circuit of claim 1, wherein the driving sub-circuit is further coupled to a second voltage terminal, and the driving sub-circuit comprises a driving transistor;

a gate electrode of the driving transistor is coupled to the second voltage terminal, a first electrode of the driving transistor is coupled to the writing sub-circuit, and a second electrode of the driving transistor is coupled to the gray scale control sub-circuit.

13. The driving circuit of claim 1, wherein the writing sub-circuit comprises a fifth transistor;

a gate electrode of the fifth transistor is coupled to the first scanning signal terminal, a first electrode of the fifth transistor is coupled to the first data signal terminal, and a second electrode of the fifth transistor is coupled to the driving sub-circuit.

14. The driving circuit of claim 1, wherein the to-be-driven element is a tiny light emitting diode.

15. A display apparatus, comprising a display substrate, the display substrate having a display region comprising a plurality of sub-pixels, at least one of the plurality of sub-pixels being provided therein with the driving circuit of claim 1 and a to-be-driven element, the driving circuit being configured to provide a driving signal to the to-be-driven element.

16. A driving method for a driving circuit, the driving circuit being the driving circuit of claim 1, wherein the driving circuit operates in a plurality of scanning periods in an image frame; the gray scale control sub-circuit comprises a first control sub-circuit and a second control sub-circuit; in the scanning period, the driving method comprises:

providing a first scanning signal to the first scanning signal terminal, providing a first data voltage to the first data signal terminal, and writing the first data voltage into the driving sub-circuit through the writing sub-circuit;

providing a second scanning signal to the second scanning signal terminal, and providing a second data voltage to the second data signal terminal, so that the second control sub-circuit is turned on or turned off under control of the second scanning signal and the second data voltage; and providing a driving control signal to the driving control signal terminal, providing a first operating voltage to the first operating voltage terminal, the first operating voltage being transmitted to the driving sub-circuit through the first control sub-circuit, so that the to-be-driven element operates based on the first data voltage and the first operating voltage under control of the driving control signal, the first scanning signal, the second scanning signal and the second data voltage.

17. The driving method of claim 16, further comprising:

in the scanning period, a time of providing an active signal by the second scanning signal terminal is later than a time of providing an active signal by the first scanning signal terminal.

18. The driving method of claim 16, wherein the driving circuit further comprises a reset sub-circuit, and prior to providing the first scanning signal to the first scanning signal terminal, providing the first data voltage to the first data signal terminal, and writing the first data voltage into the driving sub-circuit through the writing sub-circuit, the driving method further comprises:

providing a reset control signal to a reset control signal terminal, and providing a reset voltage to a reset voltage terminal, wherein the reset voltage is transmitted to the driving sub-circuit through the reset sub-circuit.

19. A driving circuit for driving a to-be-driven element, the driving circuit comprising first to seventh transistors, a first capacitor, a second capacitor, a driving transistor, a reset control signal terminal, a driving control signal terminal, a first data signal terminal, a second data signal terminal, a first scanning signal terminal, a second scanning signal terminal, a first operating voltage terminal, a first voltage terminal, and a second voltage terminal, wherein the driving control signal terminal is coupled to a gate electrode of the first transistor and a gate electrode of the second transistor, the first data signal terminal is coupled to a first electrode of the fifth transistor, the second data signal terminal is coupled to a first electrode of the third transistor, the first scanning signal terminal is coupled to a gate electrode of the fifth transistor and a gate electrode of the sixth transistor, the second scanning signal terminal is coupled to a gate electrode of the third transistor, the first operating voltage terminal is coupled to a first electrode of the first transistor, the first voltage terminal is coupled to one terminal of the first capacitor, the second voltage terminal is coupled to one terminal of the second capacitor, the reset control signal terminal is coupled to a gate electrode of the seventh transistor, the reset voltage terminal is coupled to a first electrode of the seventh transistor, a second electrode of the first transistor and a second electrode of the fifth transistor are coupled to a first electrode of the driving transistor, the other terminal of the second capacitor, a second electrode of the sixth transistor and a second electrode of the seventh transistor are coupled to a gate electrode of the driving transistor, a first electrode of the second transistor and a first electrode of the sixth transistor are coupled to a second electrode of the driving transistor, a second electrode of the second transistor is coupled to a first electrode of the fourth transistor, the other terminal of the first capacitor and a second electrode of the third transistor are coupled to a gate electrode of the fourth transistor, and a second electrode of the fourth transistor is coupled to the to-be-driven element.

20. A driving circuit for driving a to-be-driven element, the driving circuit comprising first to seventh transistors, a first capacitor, a second capacitor, a driving transistor, a reset control signal terminal, a driving control signal terminal, a first data signal terminal, a second data signal terminal, a first scanning signal terminal, a second scanning signal terminal, a power voltage terminal, a first voltage terminal, and a second voltage terminal, wherein the driving control signal terminal is coupled to a gate electrode of the first transistor and a gate electrode of the second transistor, the first data signal terminal is coupled to a first electrode of the fifth transistor, the second data signal terminal is coupled to a first electrode of the third transistor, the first scanning signal terminal is coupled to a gate electrode of the fifth transistor and a gate electrode of the sixth transistor, the second scanning signal terminal is coupled to a gate electrode of the third transistor, the power voltage terminal is coupled to a second electrode of the fourth transistor, the first voltage terminal is coupled to one terminal of the first capacitor, the second voltage terminal is coupled to one terminal of the second capacitor, the reset control signal terminal is coupled to a gate electrode of the seventh transistor, the reset voltage terminal is coupled to a first electrode of the seventh transistor, a second electrode of the first transistor and a second electrode of the fifth transistor are coupled to a first electrode of the driving transistor, the other terminal of the second capacitor, a second electrode of the sixth transistor and a second electrode of the seventh transistor are coupled to a gate electrode of the driving transistor, a first electrode of the second transistor and a first electrode of the sixth transistor are coupled to a second electrode of the driving transistor, a second electrode of the second transistor is coupled to a first electrode of the fourth transistor, the other terminal of the first capacitor and a second electrode of the third transistor are coupled to a gate electrode of the fourth transistor, and a first electrode of the first transistor is coupled to the to-be-driven element.

* * * * *